US009815269B2

(12) United States Patent
Chen

(10) Patent No.: US 9,815,269 B2
(45) Date of Patent: Nov. 14, 2017

(54) INTEGRATED OVERPRINT COLORFUL SEAL WITH MULTIPLE PRINTING SURFACES

(71) Applicant: SHENZHEN WANXI TECHNOLOGY CO., LTD., Shenzhen, Guangdong (CN)

(72) Inventor: Kai Chen, Guangdong (CN)

(73) Assignee: SHENZHEN WANXI TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/038,736

(22) PCT Filed: May 27, 2014

(86) PCT No.: PCT/CN2014/078576

§ 371 (c)(1),
(2) Date: May 23, 2016

(87) PCT Pub. No.: WO2015/096384

PCT Pub. Date: Jul. 2, 2015

(65) Prior Publication Data

US 2017/0001429 A1 Jan. 5, 2017

(30) Foreign Application Priority Data

Dec. 23, 2013 (CN) ..... 2013 2 0850082 U

(51) Int. Cl.
*B41F 15/34* (2006.01)
*B41K 1/04* (2006.01)
(Continued)

(52) U.S. Cl.
CPC ..... *B41F 15/34* (2013.01); *B41K 1/04* (2013.01); *B41K 1/06* (2013.01); *B41K 1/34* (2013.01); *B41K 1/42* (2013.01); *B41K 1/46* (2013.01)

(58) Field of Classification Search
CPC ... B41K 1/02; B41K 1/04; B41K 1/08; B41K 1/10; B41K 1/12; B41K 1/34; B41K 1/50; B41K 1/52
See application file for complete search history.

(56) References Cited

U.S. PATENT DOCUMENTS 443,831 A * 12/1890 Jones ..... B41K 1/40 101/104
1,356,172 A * 10/1920 Rumpf ..... B41K 1/04 101/108

(Continued)

FOREIGN PATENT DOCUMENTS

| | | | |
|---|---|---|---|
| CN | 2323965 | Y | 6/1999 |
| CN | 102180040 | A | 9/2011 |
| JP | 1158908 | A | 3/1999 |

OTHER PUBLICATIONS

International Search Report of PCT Patent Application No. PCT/CN2014/078576 dated Sep. 23, 2014.

*Primary Examiner* — Jennifer Simmons
*Assistant Examiner* — Marissa Ferguson Samreth

(57) ABSTRACT

An integrated overprint colorful seal with multiple printing surfaces, comprising a seal housing (1), a middle frame (2) accommodated in the seal housing (1), a spring (3) squeezed between the seal housing and the middle frame, a seal body (4) in a regular triangular prism or a quadrangular prism shape, and a driving mechanism. Each side surface of the seal body (4) in the regular triangular prism or quadrangular prism shape is a printing surface (60) in a different color and the printing surface is overprinted on a target object to show
(Continued)

a colorful seal pattern. The seal integrates the multiple printing surfaces in an integral whole, can implement semi-automatic overprint of three colors or four colors and is precise in overprint. The seal also supports printing surface replacement and ink-replenishment, and is easy to use and convenient to carry.

9 Claims, 15 Drawing Sheets

(51) Int. Cl.

| | |
|---|---|
| ***B41K 1/34*** | (2006.01) |
| ***B41K 1/06*** | (2006.01) |
| ***B41K 1/42*** | (2006.01) |
| ***B41K 1/46*** | (2006.01) |

(56) References Cited

U.S. PATENT DOCUMENTS

| | | | | |
|---|---|---|---|---|
| 3,880,079 | A * | 4/1975 | Klapholz | B41K 1/46 101/193 |
| 5,048,414 | A * | 9/1991 | Hoshino | B41K 3/64 101/103 |
| 6,945,172 | B1 * | 9/2005 | Shih | B41K 1/42 101/103 |
| 2006/0266240 | A1 * | 11/2006 | Ratnakar | B41K 1/04 101/333 |

* cited by examiner

INTEGRATED OVERPRINT COLORFUL SEAL WITH MULTIPLE PRINTING SURFACES

FIELD OF THE INVENTION

The present application relates to a portable manual device of stenciler, and more particularly to an integrated overprint colorful seal with multiple printing surfaces.

BACKGROUND OF THE INVENTION

The seals in the prior art mostly have single style and color, and a plurality of seals with different colors and patterns have to be used for manual overprint to achieve a color pattern, which is not convenient for use, and the effect of the pattern is not good. Chinese utility model patent ZL98233914.3 titled "automatic flip seal" discloses an automatic flip seal, comprising a seal housing, a central frame disposed therein, a spring squeezed between the seal housing and the central frame, and a seal fixed in the central frame by a fixed rod. The automatic flip seal can flip automatically to be oiled, flip automatically to print, and is convenient to carrying. However, the automatic flip seal has only one printing surface and can only achieve monochrome printing function.

SUMMARY OF THE INVENTION

The technical problem to be solved by the present application is to provide an integrated overprint color seal with multiple printing surfaces which can solve the problem of monochrome printing and manual overprint, so as to overcome the defect in the prior art.

The present application provides the following technical solution to solve the technical problem: an integrated overprint colorful seal with multiple printing surfaces, comprising a seal housing, a middle frame accommodated in the seal housing, a spring squeezed between the seal housing and the middle frame, a seal body in a regular triangular prism or a quadrangular prism shape, and a driving mechanism; wherein each side surface of the seal body in the regular triangular prism or quadrangular prism shape is a printing surface in a different color; a fixed shaft passes through the centers of two end surface of the seal body which are parallel to each other, the two ends of the fixed shaft pass through the vertical grooves on the vertical walls at two sides of the middle frame respectively and are supported on the vertical walls at two sides of the lower portion of the seal housing, so that the seal body is suspended in the middle frame; the drive mechanism is mounted at both ends of the fixed shaft, wherein a ratchet or gear of the drive mechanism is fixed on one end surface of the seal body, and a pawl or rack which engages with the ratchet or gear to drive the seal body to rotate is fixed on the middle frame; when the seal housing is not depressed, the spring is in an extended state and the printing surface in one color of the seal body faces downwards; when the seal housing is depressed, the spring will be squeezed, the seal body will be moved downwards along the vertical grooves on the vertical walls at two sides of the middle frame with the fixed shaft until the printing surface in the one color prints on the target, when the seal housing is relaxed, the seal body will be moved upwards with the fixed shaft while the driving mechanism will drive the seal body to rotate about the axis of the fixed shaft until the printing surface of the seal body in another color faces downwards; when the seal housing is depressed again, the printing surface in another color will overprint on the existing printed pattern on the target, and so forth, colorful printed pattern will be presented on the target after the printing surfaces in three colors or four colors are overprinted.

The drive mechanism comprises a gear mechanism and a positioning wheel which are mounted on the two ends of the fixed shaft projecting from the central part of the seal body respectively; the gear mechanism comprises a gear and a one-way bearing, and the one-way bearing has an inner ring which is sleeved on one end of the fixed shaft slidably and is fixed on the end surface of the seal body, the gear is sleeved on the outer ring of the one-way bearing tightly and is integrated with the one-way bearing; a rack is fixed on the vertical groove wall of the vertical groove which is at the same end of the middle frame as the gear, and the gear mechanism engages with the rack; when the seal housing is depressed, the gear will rotate downwards along the rack to drive the outer ring of the one-way bearing rotate and the seal body will not rotate; when the seal housing is relaxed, the gear will move upwards along the rack and rotate, the one-way bearing will be locked and can not rotate, therefore the inner ring, the outer ring and the seal body will rotate by one-third or one quarter of the circumference; the positioning wheel is mounted on the fixed shaft at the other side of the seal body, three or four projecting ribs are distributed uniformly on a tubular outer wall of the positioning wheel, recessed positioning grooves are arranged on the end surface of the projecting ribs which faces towards the vertical wall of the seal housing, projecting positioning ribs fitting with the positioning grooves of the positioning wheel are arranged on the vertical wall of the seal housing correspondingly.

The gear ratio of the gear and the rack is 3:1 or 4:1 based on the shape of the seal body being a regular triangular prism or a quadrangular prism.

A recess fitting with the projecting ribs of the positioning wheel is formed at the bottom of the vertical groove which is at the same side as the positioning wheel, when the seal housing is depressed, the seal body will move with the fixed shaft along the vertical groove to the bottom of the vertical groove, and the projecting rib of the positioning wheel will embed into the recess of the vertical groove.

The driving mechanism comprises a pawl mechanism and a positioning mechanism, the pawl mechanism comprises a ratchet, a pawl and a pawl return spring, the ratchet is fixed on one end of the fixed shaft and is integrated with the fixed shaft, the pawl and a pawl return spring are fixed on the inner wall of the middle frame; the positioning mechanism comprises an anti-inertia positioning wheel, the anti-inertia positioning wheel is mounted on the fixed shaft on the other end of the seal body and is fixed on the end surface of the seal body, three or four projecting ribs are distributed uniformly on the tubular outer wall of the positioning wheel and recessed positioning grooves are arranged on the end surface of projecting ribs which faces towards the vertical wall of the seal housing, projecting positioning ribs fitting with the positioning grooves of the positioning wheel are arranged on the vertical wall of the seal housing correspondingly; when the seal body rotates upwards with the fixed shaft, the ratchet is driven by the pawl, and the seal body is driven to rotate by one-third or one quarter of circumference, so that the positioning grooves are embedded by the projecting positioning ribs on the vertical wall of the seal housing to be positioned accurately.

The positioning mechanism further comprises an anti-reversal one-way bearing, and an inner ring of the anti-reverse one-way bearing is fixed on the fixed shaft on the same side as the anti-inertial positioning wheel, the anti-inertial positioning wheel is sleeved on an outer ring of the anti-reversal one-way bearing slidably and is fixed on the end surface of the seal body.

A recess fitting with the projecting ribs of the positioning wheel is formed at the bottom of the vertical groove which is at the same side as the positioning wheel, when the seal housing is depressed, the seal body moves with the fixed shaft along the vertical groove to the bottom of the vertical groove, and the projecting ribs of the positioning wheel embed into the recesses of the vertical groove.

The number of the teeth of the ratchet is three or four based on the seal body being in a regular triangular prism shape or quadrangular prism shape, and the teeth are distributed uniformly.

On the fixed shaft at the same end as the positioning wheel, the top end part inserted into the vertical wall of the seal housing is in a flat shape which is not rotatable.

The printing surfaces are fixed on the ink pads which can store ink and are integrated with the ink pads, the ink pads are embedded detachably in the side surfaces of the seal body in regular triangular prism shape or quadrangular prism shape, and refilling holes for refilling ink are formed on the ink pads.

Compared with the prior art, the following advantageous effect can be achieved by the present application: the seal integrates the multiple printing surface in an integral whole, can implement semi-automatic overprint of three colors or four colors and is precise in overprint. The seal also supports printing surface replacement and ink-replenishment, and is easy to use and convenient to carry.

DETAILED DESCRIPTION OF THE PREFERRED EMBODIMENT

Figure 1:
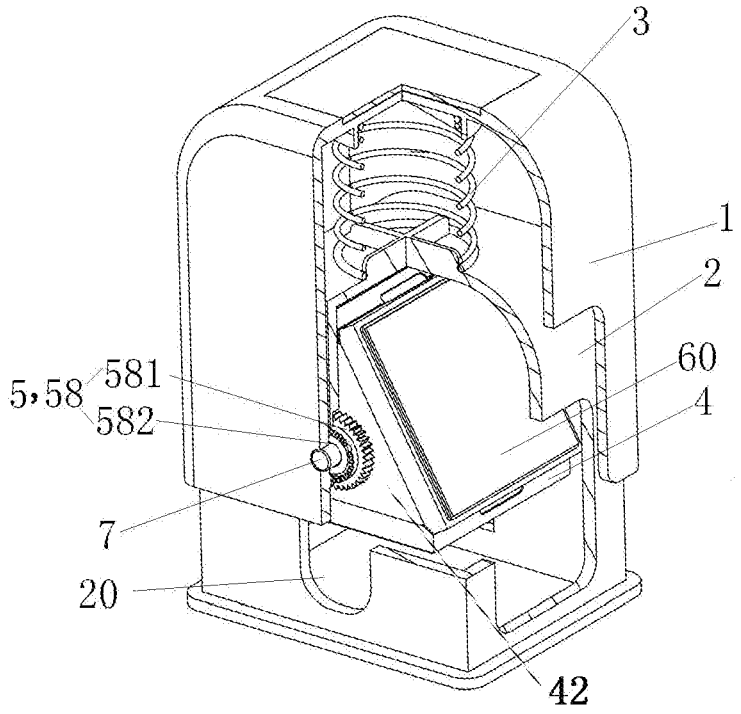
FIG. 1 is a break-out view based on axonometric projection of an integrated overprint colorful seal with multiple printing surfaces according to a preferred first embodiment of the present application, wherein the rotation mechanism 5 is a gear mechanism 58, and the seal body is in a regular triangular prism shape.
Figure 2:
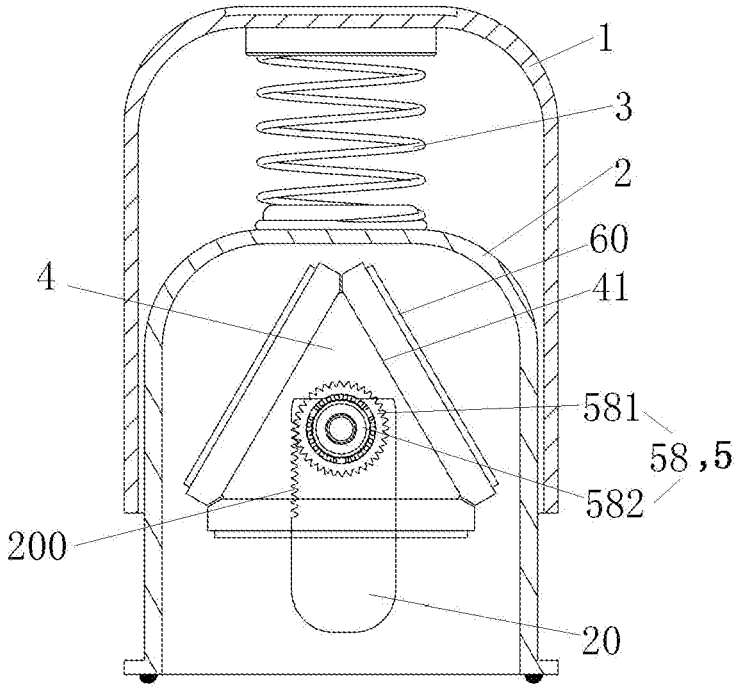
FIG. 2 is an orthographic left side view of the first embodiment.

The present application will be further illustrated in the following with reference to the preferred embodiments shown in the accompanying drawings.

Refer to FIGS. 1 to 8, an integrated overprint colorful seal with multiple printing surfaces according to a preferred first embodiment of the present application comprises a seal housing 1, a middle frame 2 accommodated in the seal housing 1, a spring 3 squeezed between the seal housing and the middle frame, a seal body 4 in a regular triangular prism shape, and a driving mechanism 5. Each side surface 41 of the seal body 4 is a printing surface 60 with a same pattern profile in a different color. A fixed shaft 7 passes through the centers of two end surface 42 of the seal body 4 which are parallel to each other. The two ends of the fixed shaft 7 pass through the vertical grooves 20 on the vertical walls at two sides of the middle frame 2 respectively and are supported on the vertical walls at two sides of the lower portion of the seal housing 1, so that the seal body 4 is suspended in the middle frame 5. The drive mechanism 5 is mounted at both ends of the fixed shaft 7. In this embodiment, the drive mechanism 5 comprises a gear mechanism 58 and a positioning wheel 59 which are mounted on the two ends of the fixed shaft 7 projecting from the central part of the seal body 4 respectively. The gear mechanism 58 comprises a gear 581 and a one-way bearing 582, and the one-way bearing 582 has an inner ring which is sleeved on one end of the fixed shaft 7 slidably and is fixed on the end surface of the seal body 4. The gear 581 is sleeved on the outer ring of the one-way bearing 582 tightly and is integrated with the one-way bearing 582. A rack 200 is fixed on the vertical groove wall of the vertical groove 20 which is at the same end of the middle frame 2 as the gear 581, and the gear mechanism 58 engages with the rack 200. The gear ratio of the gear 581 and the rack 200 is 3:1. When the seal housing 1 is depressed, the gear 581 rotates downwards along the rack to drive the outer ring of the one-way bearing 582 rotate while the seal body 4 does not rotate; when the seal housing is relaxed, the gear 581 goes upwards along the rack and rotates, the one-way bearing 582 is locked and can not rotate, therefore the inner ring, the outer ring and the seal body rotate by one-third of the circumference together with the gear 581.

Figure 3:
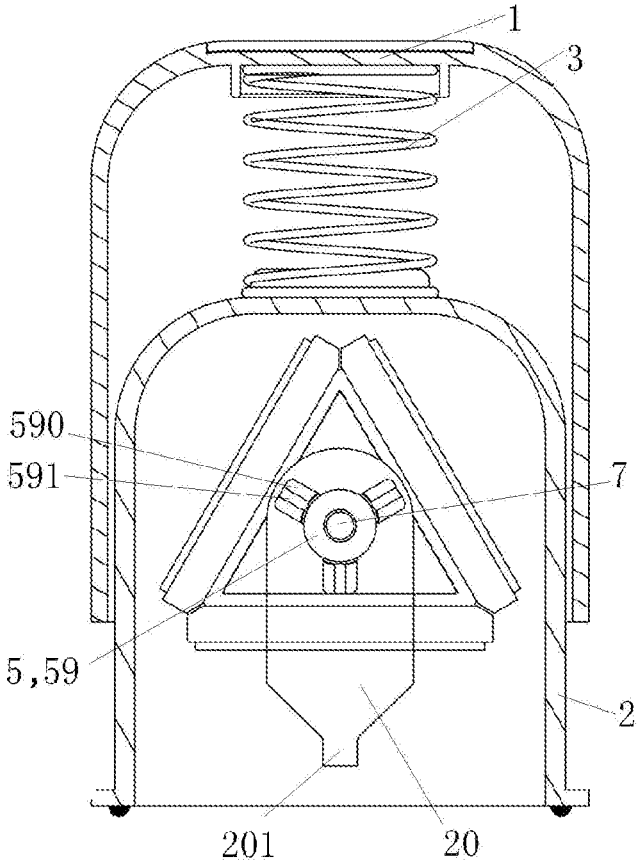
FIG. 3 is an orthographic right side view of the first embodiment.
Figure 4:
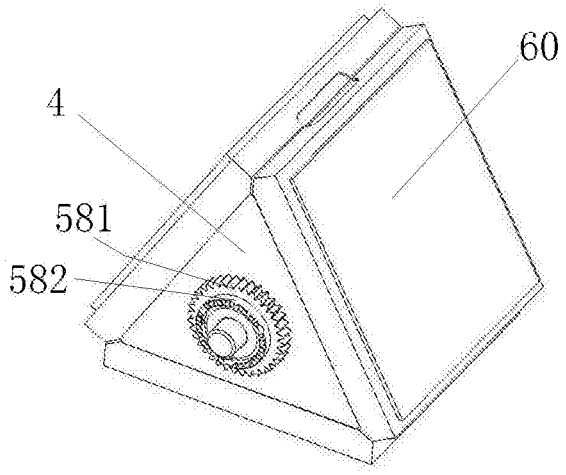
FIG. 4 is a view based on left axonometric projection of the seal body 4 in the first embodiment.
Figure 5:
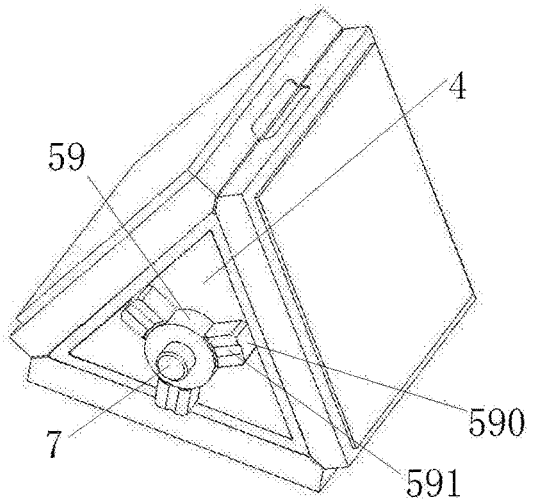
FIG. 5 is a view based on right axonometric projection of the seal body 4 in the first embodiment.
Figure 7:
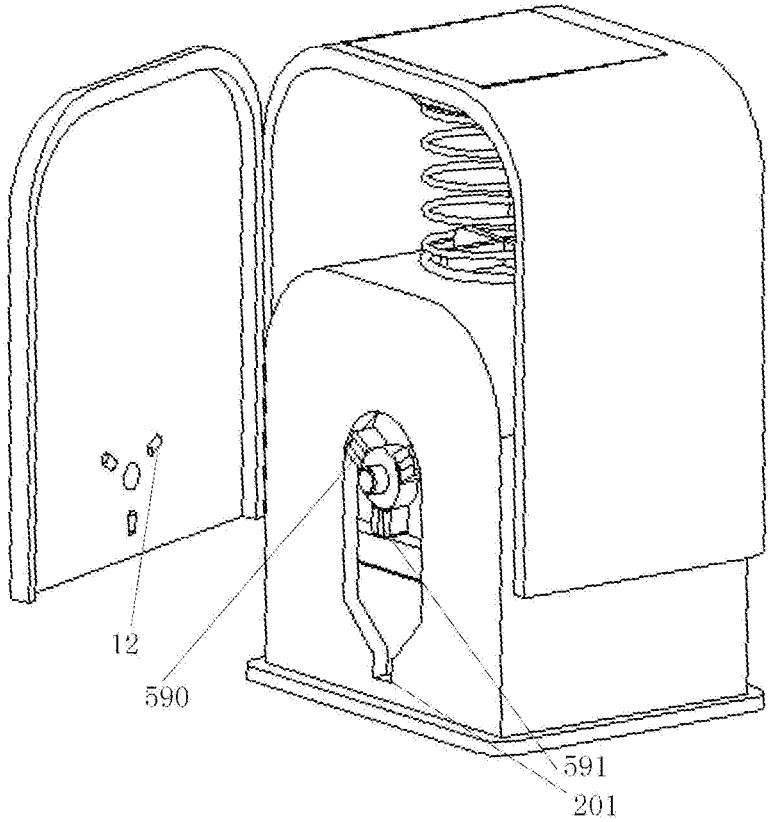
FIG. 7 is a view based on axonometric projection of the first embodiment with the anti inertial positioning wheel 59 and the seal housing 1 expanded.

Referring to FIG. 3, FIGS. 5 and 7, the positioning wheel 59 is mounted on the fixed shaft 7 at the other side of the seal body 4. Three projecting ribs 590 are distributed uniformly on a tubular outer wall of the positioning wheel 59, recessed positioning grooves 591 are arranged on the end surface of the projecting ribs 590 which faces towards the vertical wall of the seal housing 1. Meanwhile, projecting positioning ribs 12 fitting with the positioning grooves 591 of the positioning wheel 522 are arranged on the vertical wall of the seal housing 1 correspondingly. When the seal housing 1 is not depressed, the gear 581 rotates upwards along the rack to drive the seal body 4 to rotate by one-third of the circumference together with the gear 581, so that the positioning ribs 12 on the vertical wall of the seal housing 1 embed into the positioning grooves 591 to be positioned precisely, and inertial rotation is prevented.

A recess 201 fitting with the projecting ribs 590 of the positioning wheel 59 is formed at the bottom of the vertical groove 20 which is at the same side as the positioning wheel 59. When the seal housing 1 is depressed and the seal body 4 moves with the fixed shaft 7 along the vertical groove 20 to the bottom of the vertical groove 20, the projecting rib 590 of the positioning wheel 59 embeds into the recess 201 of the vertical groove 20.

Figure 6:
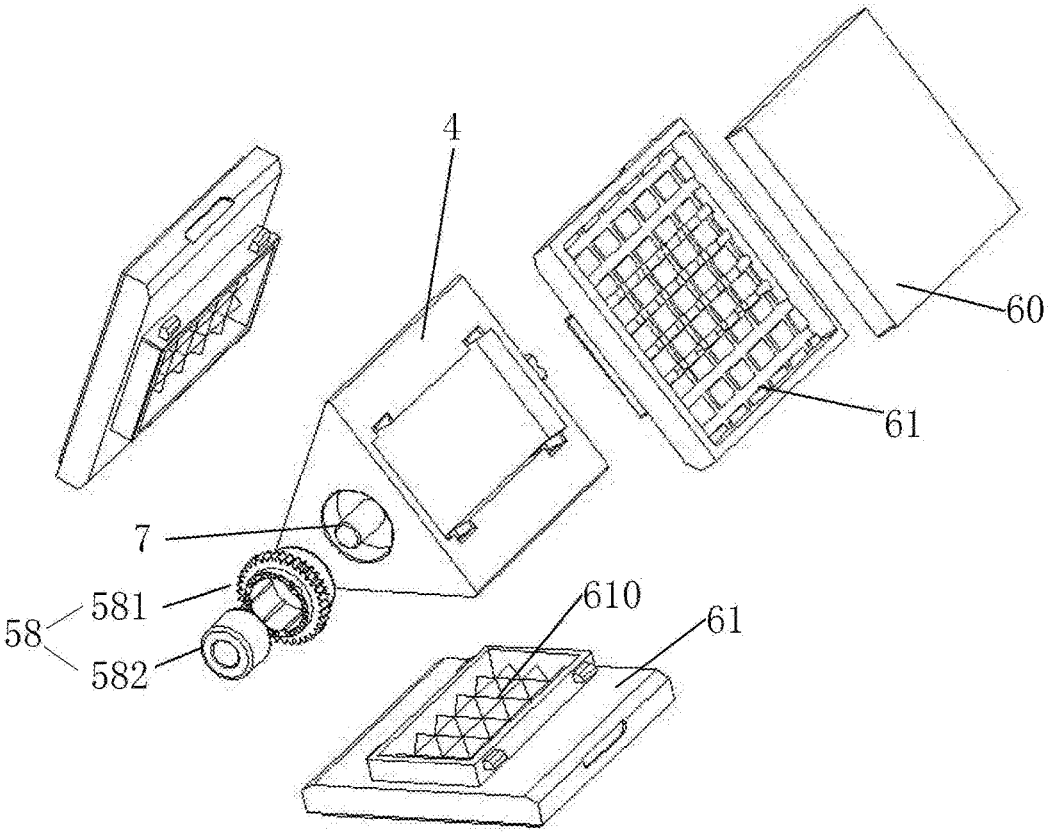
FIG. 6 is a view based on axonometric projection of the seal body 4 with components in separated state in the first embodiment.

Referring to FIG. 6, the printing surfaces 60 are fixed on the ink pads 61 which can store ink and are integrated with the ink pads 61. The ink pads 61 are embedded detachably in the side surfaces 41 of the seal body 4 in triangular prism shape, and refilling holes 610 for refilling ink are formed on the ink pads 61.

Referring to FIGS. 9 to 12, the preferred second embodiment of the present application is substantially similar to the first embodiment, except that the seal body 4 is in a quadrangular prism shape, the gear ratio of the gear 581 and the rack 200 is 4:1, four projecting ribs 590 are distributed uniformly on the tubular outer wall of the positioning wheel 59, and the number of the projecting positioning ribs 12 on the vertical wall of the seal housing 1 is four correspondingly.

Figure 8:
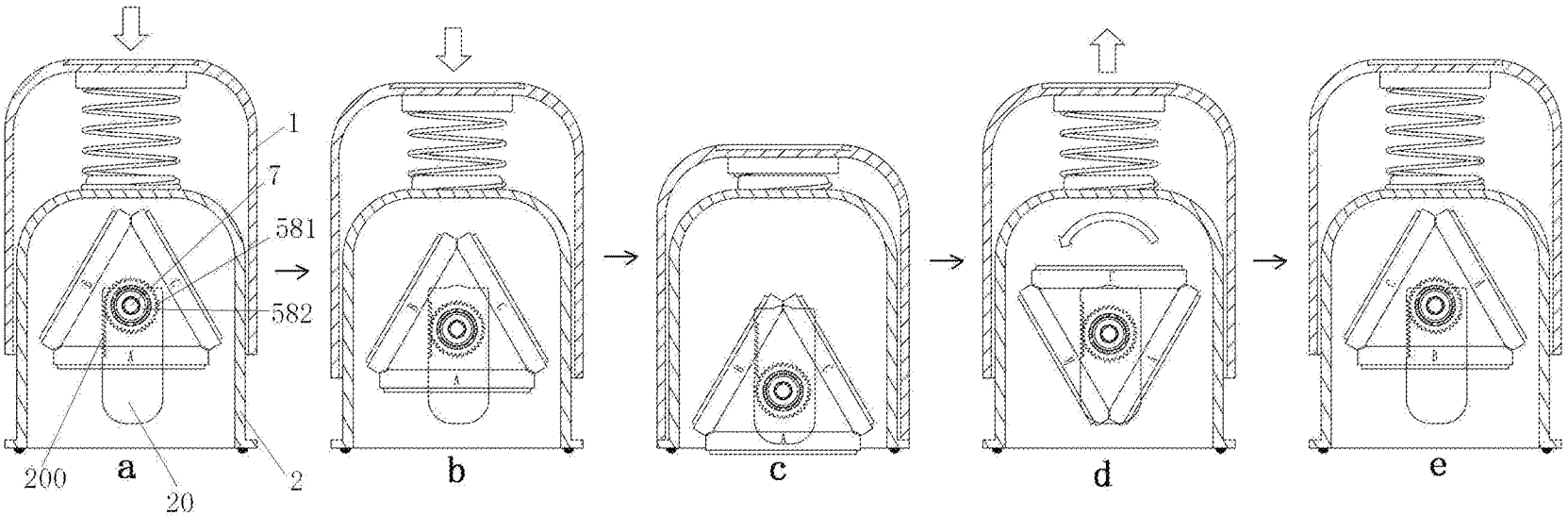
FIG. 8 is a schematic diagram of working principle of the colorful seal in the first embodiment.
Figure 9:
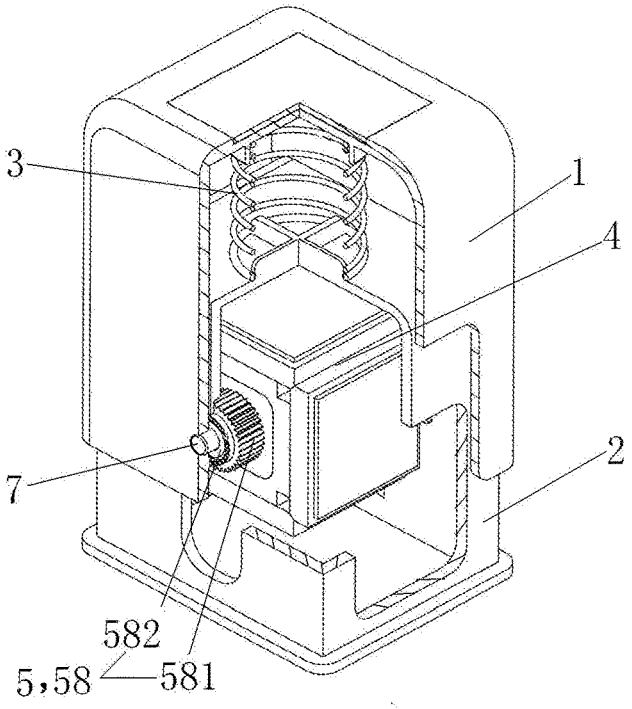
FIG. 9 is a break-out view based on axonometric projection of a colorful seal according to a preferred second embodiment of the present application, wherein the drive mechanism 5 is a gear mechanism 58, and the seal body is in a quadrangular prism shape.
Figure 10:
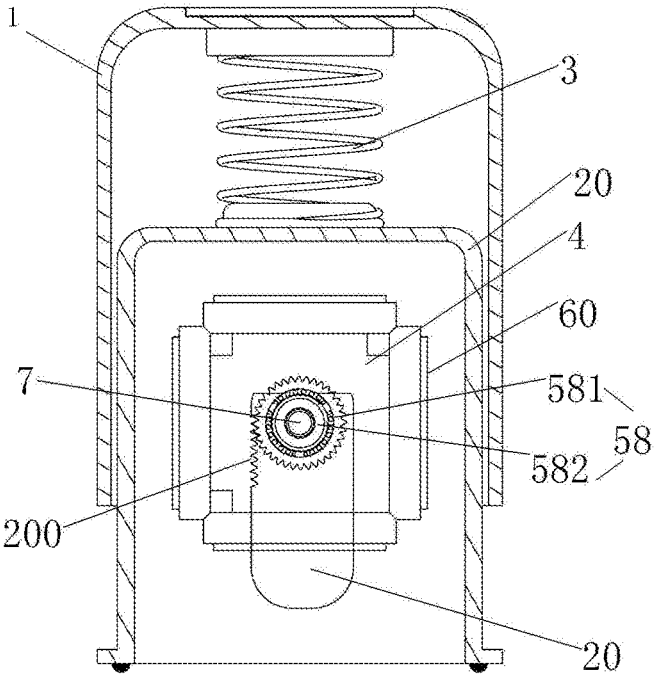
FIG. 10 is an orthographic left side view of the colorful seal in the second embodiment.
Figure 11:
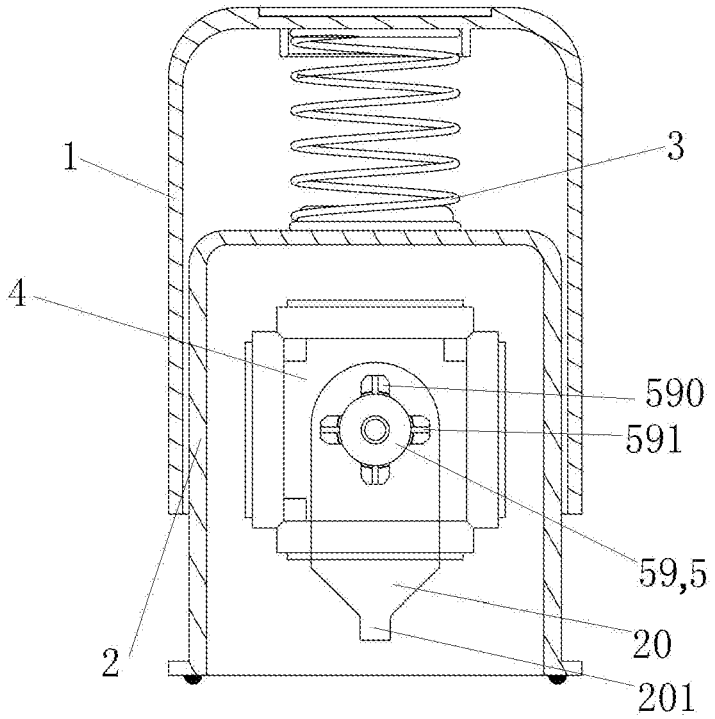
FIG. 11 is an orthographic right side view of the colorful seal in the second embodiment.
Figure 12:
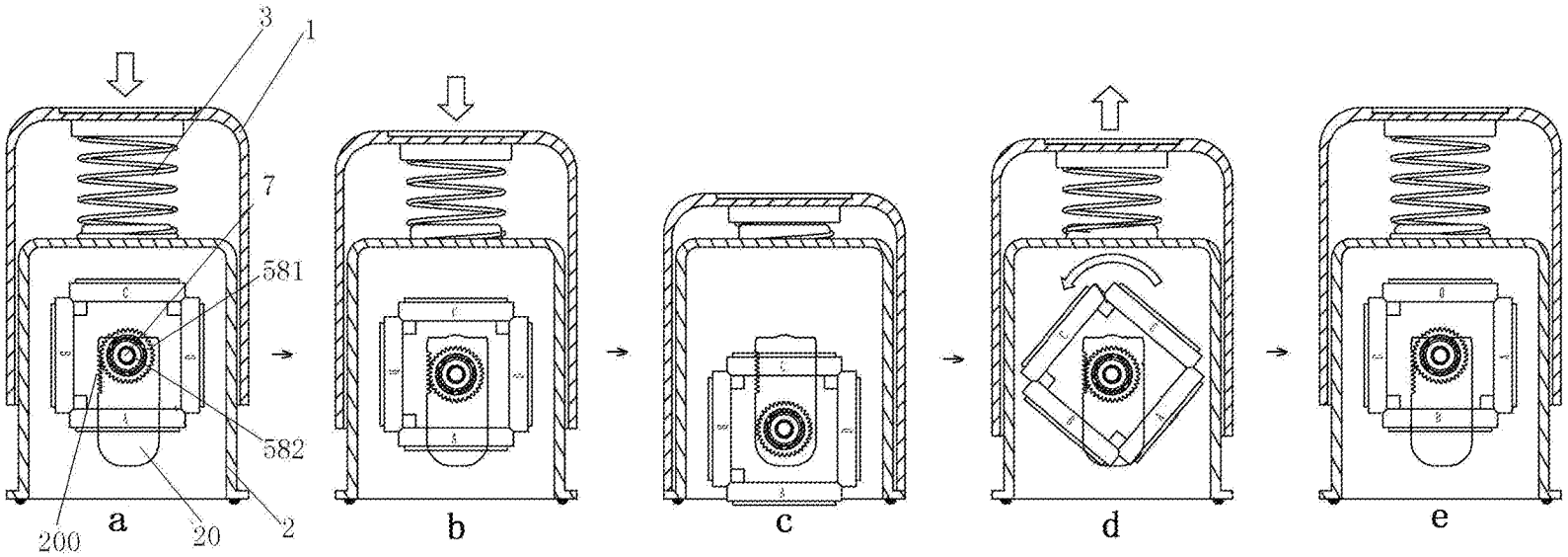
FIG. 12 is a schematic diagram of working principle of the colorful seal in the second embodiment.
Figure 13:
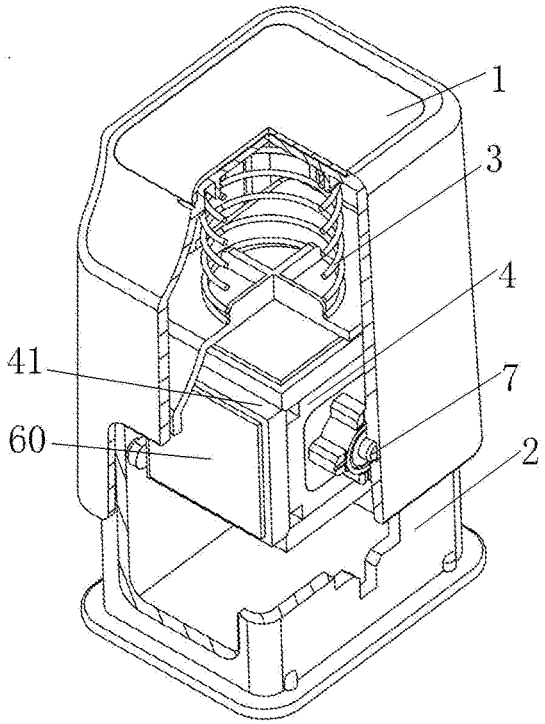
FIG. 13 is a break-out view based on axonometric projection of a preferred third embodiment of the present application, wherein the rotation mechanism 5 is a ratchet mechanism 51, and the seal body is in a quadrangular prism shape.
Figure 14:
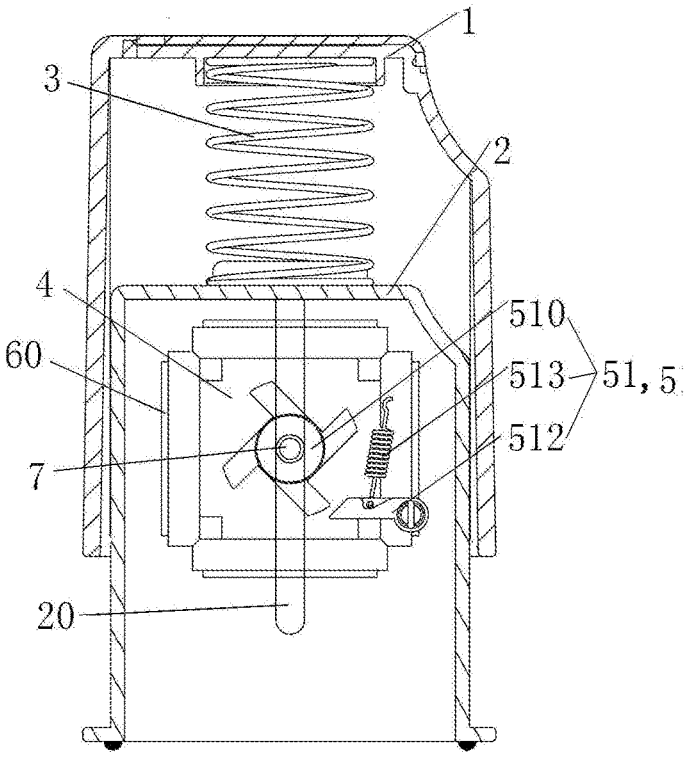
FIG. 14 is an orthographic left side view of the colorful seal in the third embodiment.
Figure 15:
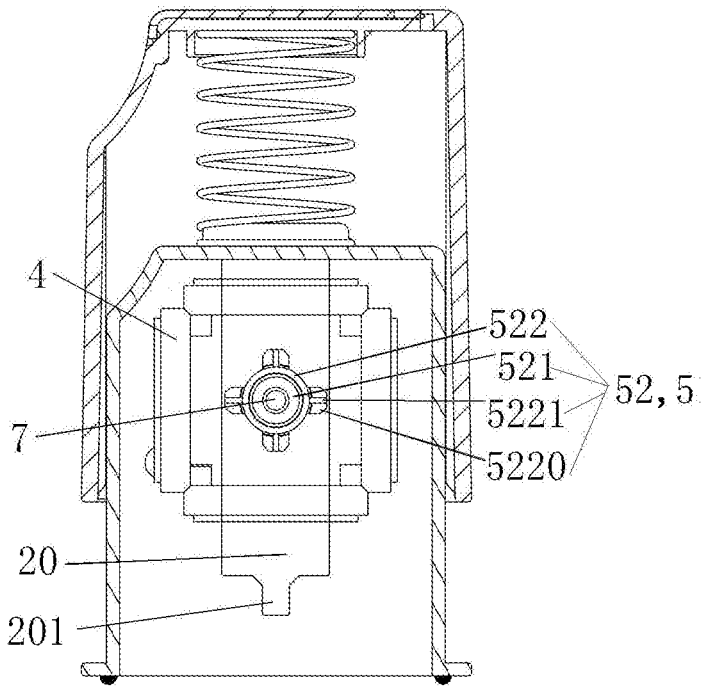
FIG. 15 is an orthographic right side view of the colorful seal in the third embodiment.
Figure 16:
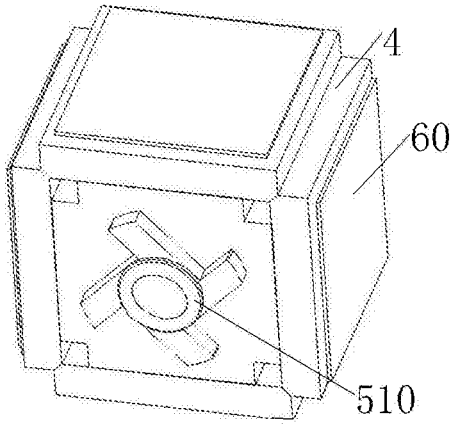
FIG. 16 is a view based on left axonometric projection of the seal body 4 in the third embodiment.

Referring to FIGS. 8 and 12, the working principle of the first embodiment and the second embodiment is described briefly as following:

1. When the seal housing 1 is not depressed, the spring 3 will be in an extended state and the printing surface 60 in one color A of the seal body 4 will face downwards. When the seal housing 1 is depressed, the spring 3 will be squeezed and the seal body 4 will be moved downwards together with the gear 581 along the rack to drive the outer ring of the one-way bearing 582 rotate. Then the seal body 4 moves to the bottom of the vertical grooves 20 on the vertical walls at two sides of the middle frame and does not rotate, and the printing surface in one color A of the seal body is printed on the target. At this time, the projecting rib 590 of the positioning wheel 59 embed into the recess 201 of the vertical groove 20 which is at the same side as the projecting rib 590, therefore the seal body can not move when printing, as shown in the states a to c in FIGS. 8 and 12.

2. When the seal housing 1 is relaxed, the gear 581 will move upwards along the rack and rotates, the one-way bearing 582 will be locked and can not rotate. Therefore the inner ring, the outer ring and the seal body 4 rotate together with the gear 581. When the gear 581 arrives at the up stop point of the rack, the seal body 1 in triangular prism shape will rotate 120° and the seal body 1 in quadrangular prism shape will rotate 90°, the printing surface in another color B of the seal body 1 will face downwards. Thus, the change of the printing surface is achieved, as shown in the states d to e in FIGS. 8 and 12.

3. When the seal housing 1 is depressed again, the printing surface 60 in another color B will be overprinted on the existing pattern on the target, and so forth. The printing surfaces in three colors of seal body in triangular prism shape will be overprinted three times, and the printing surfaces in four colors of seal body in quadrangular prism shape will be overprinted four times. After printed by the printing surfaces in three colors A to C of seal body in triangular prism shape or by the printing surfaces 60 in four colors A to C of seal body in quadrangular prism shape, colorful pattern is presented on the target.

Referring to FIG. 13 to FIG. 19, the preferred third embodiment of the present application is substantially similar to the second embodiment, except that the driving mechanism comprises a pawl mechanism 51 and a positioning mechanism 52, wherein the pawl mechanism 51 comprises a ratchet 510, a pawl 512 and a pawl return spring 513. The ratchet 510 is fixed on one end of the fixed shaft 7 and is integrated with the fixed shaft 7. The pawl and a pawl return spring are fixed on the inner wall of the middle frame 2. The number of the teeth of the ratchet 510 is four and the teeth are distributed uniformly.

An anti-inertia positioning wheel 522 of the positioning mechanism 52 is mounted on the fixed shaft 7 on the other end of the seal body 4 in quadrangular prism shape and is fixed on the end surface of the seal body 4. Three or four projecting ribs 5220 are distributed uniformly on the tubular outer wall of the positioning wheel 522 and recessed positioning grooves 5221 are arranged on the end surface of projecting ribs 5220 which are faced towards the vertical wall of the seal housing 1. Projecting positioning ribs 12 fitting with the positioning grooves 5221 of the positioning wheel 522 are arranged on the vertical wall of the seal housing 1 correspondingly. When the seal body 4 goes upwards with the fixed shaft, the ratchet 510 is driven by the pawl 512, and the seal body 4 is driven to rotate around the fixed shaft 7 by one quarter of circumference, so that the positioning grooves 5221 is embedded by the projecting positioning ribs 12 on the vertical wall of the seal housing 1 to be positioned accurately.

Figure 17:
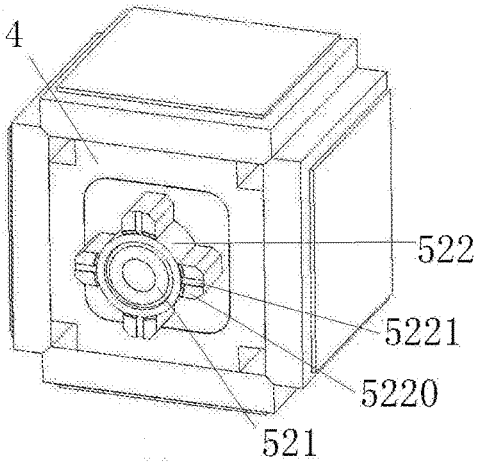
FIG. 17 is a view based on right axonometric projection of the seal body 4 in the third embodiment.

Referring to FIG. 17, for position more accurately, the positioning mechanism 52 further comprises an anti-reversal one-way bearing 521, and the anti-reverse one-way bearing 521 has an inner ring which is fixed on the fixed shaft 7 on the same side as the anti-inertial positioning wheel 522. The anti-inertial positioning wheel 522 is sleeved on an outer ring of the anti-reversal one-way bearing 521 slidably and is fixed on the end surface of the seal body 4.

Similar to the previous embodiments, the recess 201 fitting with the projecting ribs 5220 of the positioning wheel 522 is formed at the bottom of the vertical groove 20 which is at the same side as the positioning wheel 522. When the seal housing 1 is depressed and the seal body 4 moves with the fixed shaft 7 along the vertical groove 20 to the bottom of the vertical groove 20, the projecting rib 5220 of the positioning wheel 522 embeds into the recess 201 of the vertical groove 20. As shown in FIG. 8, on the fixed shaft 7 at the same side as the positioning wheel 522, the top end part 71 inserted into the vertical wall of the seal housing is in a flat shape which is not rotatable.

Figure 18:
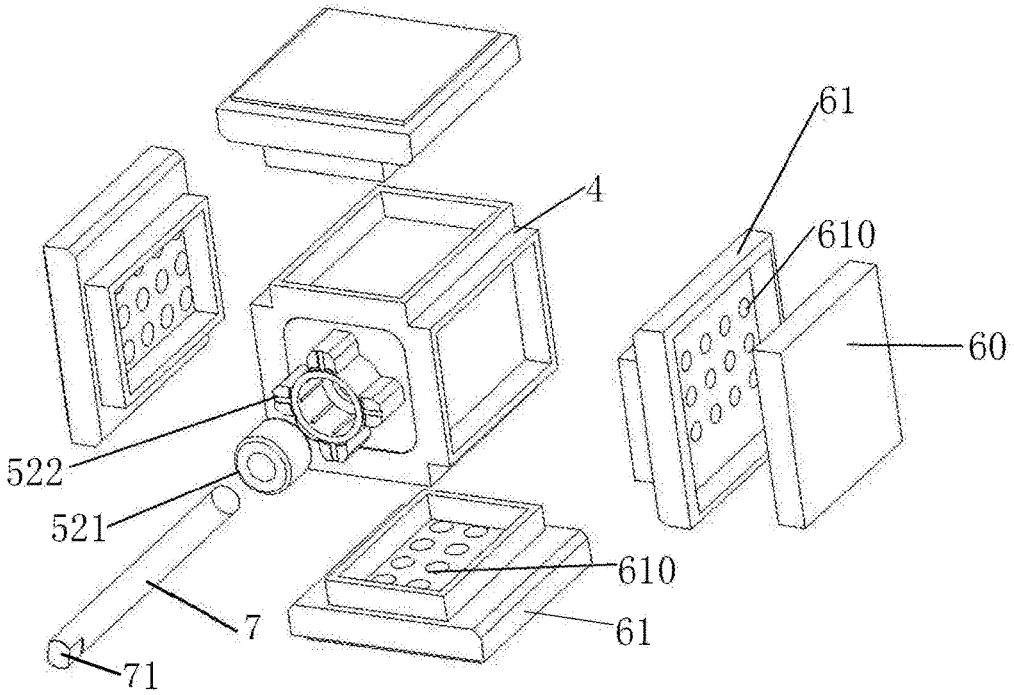
FIG. 18 is a view based on axonometric projection of the seal body 4 with components in separated state in the third embodiment.

Referring to FIG. 18, the printing surfaces 60 are fixed on the ink pads 61 which can store ink and are integrated with the ink pads 61. The ink pads 61 are embedded detachably in the side surfaces 41 of the seal body 4 in quadrangular prism shape, and refilling holes 610 for refilling ink are formed on the ink pads 61.

Referring to FIGS. 20 to 23, the preferred fourth embodiment of the present application is substantially similar to the third embodiment, except that the seal body 4 is in a regular triangular prism shape, and there are three teeth distributed on the ratchet 510 uniformly. Three projecting ribs 5220 are distributed uniformly on the tubular outer wall of the positioning wheel 522, and the number of the projecting positioning ribs on the vertical wall of the seal housing 1 is four correspondingly.

Figure 19:
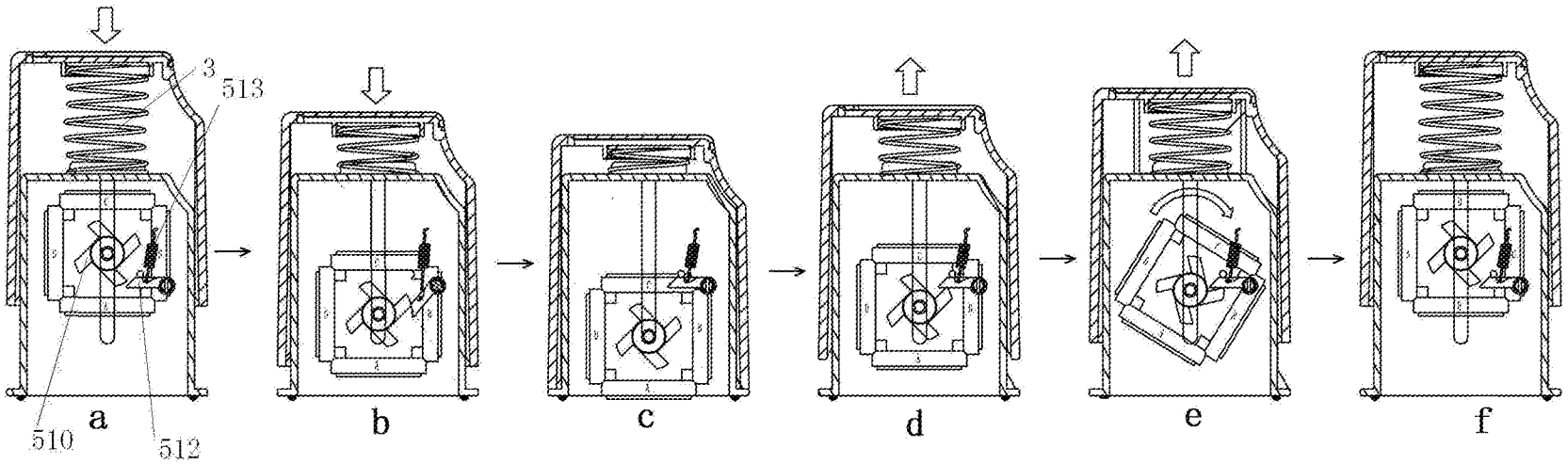
FIG. 19 is a schematic diagram of working principle of the colorful seal in the third embodiment.
Figure 20:
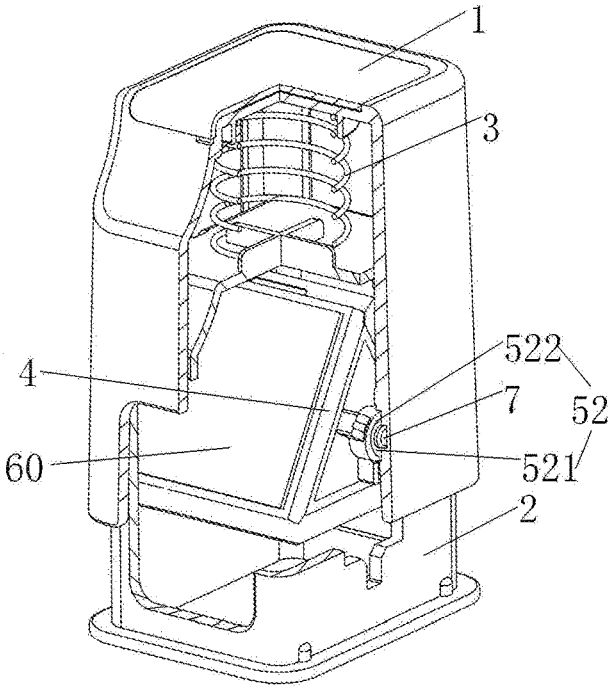
FIG. 20 is a break-out view based on axonometric projection of a preferred fourth embodiment of the present application, wherein the rotation mechanism 5 is a ratchet mechanism 51, and the seal body is in a regular triangular prism shape.
Figure 21:
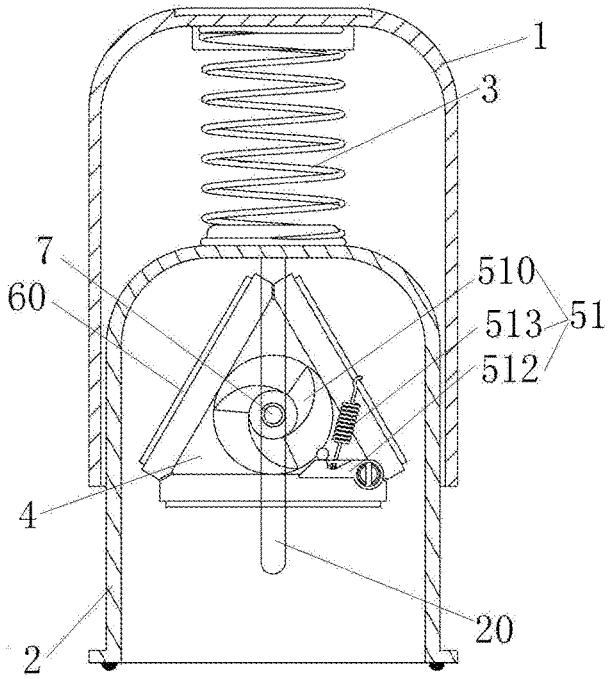
FIG. 21 is an orthographic left side view of the fourth embodiment.
Figure 22:
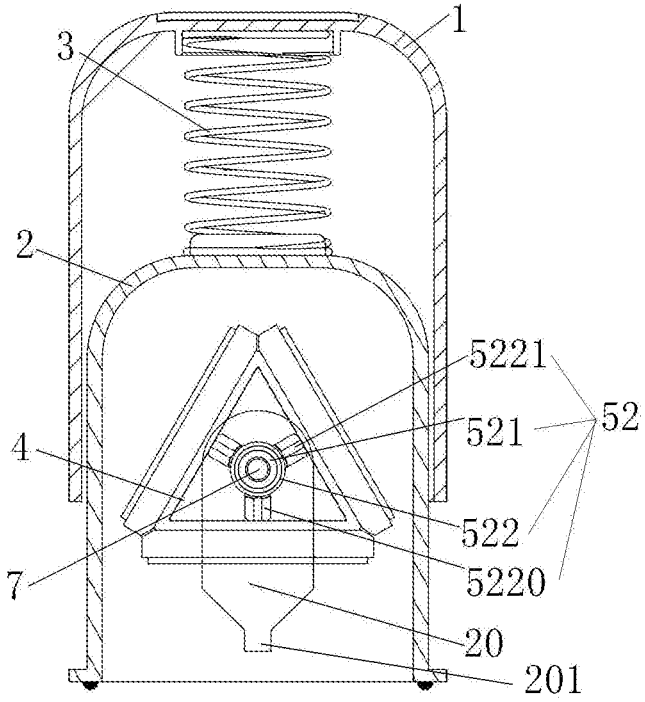
FIG. 22 is an orthographic right side view of the fourth embodiment.
Figure 23:
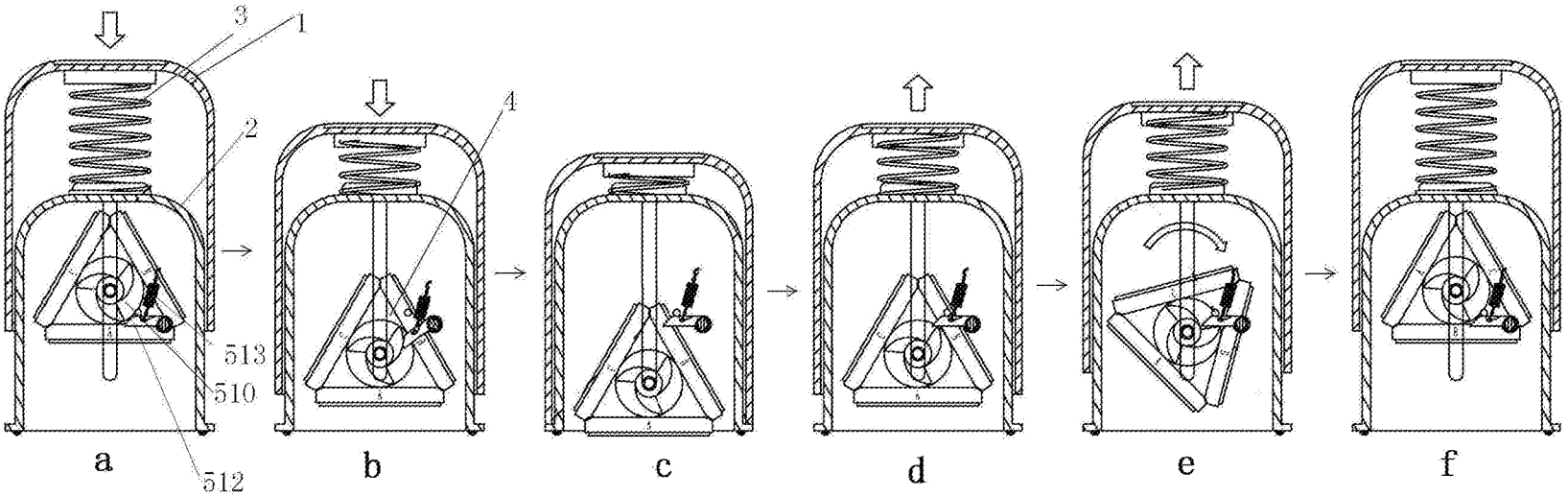
FIG. 23 is a schematic diagram of working principle of the colorful seal in the fourth embodiment.

Referring to FIGS. 19 and 23, the working principle of the third embodiment and the fourth embodiment is described briefly as following:

1. When the seal housing 1 is not depressed, the spring 3 will be in an extended state and the printing surface 60 in one color A of the seal body 4 will face downwards. When the seal housing 1 is depressed, the ratchet 510 will not be driven by the pawl 512, the seal body 4 will be moved together with the seal housing 1 to the bottom of the vertical grooves 20 on the vertical walls at two sides of the middle frame 2 and does not rotate, and the printing surface in one color A of the seal body will be printed on the target. At this time, the projecting rib 5220 of the positioning wheel 522 embed into the recess 201 of the vertical groove 20 which will be at the same side as the projecting rib 590. Therefore the seal body 4 can not move when printing, as shown in the states a to c in FIGS. 19 and 23.

2. When the seal housing 1 is relaxed, the seal body 1 moves upwards with the fixed shaft 7, the ratchet 510 is driven by the pawl 512 and the seal body 1 is driven to rotate. When the spring 3 recovers to its original extended state, the pawl will be separated from the ratchet, the seal body 1 in triangular prism shape will rotate 120° and the seal body 1 in quadrangular prism shape will rotate 90°, the printing surface 60 in another color B of the seal body 4 will face downwards. Therefore the change of the printing surface is achieved, as shown in the states d to f in FIGS. 19 and 23.

3. When the seal housing 1 is depressed again, the printing surface 60 in another color B is overprinted on the existing pattern on the target, and so forth. The printing surfaces in three colors of seal body in triangular prism shape will be overprinted three times, and the printing surfaces in four colors of seal body in quadrangular prism shape will be overprinted four times. After printed by the printing surfaces in three colors A to C of seal body in triangular prism shape or by the printing surfaces 60 in four colors A to C of seal body in quadrangular prism shape, colorful pattern is presented on the target.

What is claimed is:

1. An integrated overprint colorful seal with multiple printing surfaces, comprising:

a seal housing (1), a middle frame (2) accommodated in the seal housing (1), a spring (3) squeezed between the seal housing and the middle frame, wherein the integrated overprint colorful seal further comprises a seal body (4) in a regular triangular prism or a quadrangular prism shape, and a driving mechanism (5);

each side surface of the seal body (4) in the regular triangular prism or quadrangular prism shape is a printing surface (60) for printing a different color;

a fixed shaft (7) passes through centers of two end surface (42) of the seal body (4) which are parallel to each other, two ends of the fixed shaft (7) pass through vertical grooves (20) on vertical walls at two sides of the middle frame (2) respectively and are supported on the vertical walls at two sides of a lower portion of the seal housing (1), so that the seal body (4) is suspended in the middle frame (2);

the drive mechanism (5) is mounted at both ends of the fixed shaft (7), wherein a ratchet (510) or gear (581) of the drive mechanism (5) is fixed on one end surface (42) of the seal body (4), and a pawl (512) or rack (200) which engages with the ratchet (510) or gear (581) to drive the seal body (4) to rotate is fixed on the middle frame (2);

when the seal housing (1) is not depressed, the spring (3) is in an extended state and the printing surface (60) in one color of the seal body (4) faces downwards;

when the seal housing (1) is depressed, the spring (3) will be squeezed, the seal body (4) will be moved downwards along the vertical grooves (20) on the vertical walls at two sides of the middle frame (2) with the fixed shaft (7) until the printing surface (60) in the one color prints on a target;

when the seal housing (1) is relaxed, the seal body (4) will be moved upwards with the fixed shaft (7) while the driving mechanism (5) will drive the seal body (4) to rotate about an axis of the fixed shaft (7) until the printing surface (60) of the seal body (4) in another color faces downwards;

when the seal housing (1) is depressed again, the printing surface (60) in another color will overprint on an existing printed pattern on the target, and so forth, colorful printed pattern will be presented on the target after the printing surfaces (60) in three colors or four colors are overprinted;

wherein the drive mechanism (5) comprises a gear mechanism (58) and a positioning wheel (59) which are mounted on the two ends of the fixed shaft (7) projecting from a central part of the seal body (4) respectively;

the gear mechanism (58) comprises a gear (581) and a one-way bearing (582), and the one-way bearing (582) has an inner ring which is sleeved on one end of the fixed shaft (7) slidably and is fixed on one of the end surfaces of the seal body (4), the gear (581) is sleeved on an outer ring of the one-way bearing (582) tightly and is integrated with the one-way bearing (582), a rack (200) is fixed on the vertical groove wall of the vertical groove (20) which is at the same end of the middle frame as the gear (581);

the gear mechanism (58) engages with the rack (200);

when the seal housing (1) is depressed, the gear (581) will rotate downwards along the rack (200) to drive the outer ring of the one-way bearing (582) rotate and the seal body (4) will not rotate;

when the seal housing (1) is relaxed, the gear will move upwards along the rack (200) and rotate, the one-way bearing (582) will be locked and can not rotate, therefore the inner ring, the outer ring and the seal body (4) will rotate by one-third or one quarter of circumference;

the positioning wheel (59) is mounted on the fixed shaft (7) at an other side of the seal body (4), three or four projecting ribs (590) are distributed uniformly on a tubular outer wall of the positioning wheel (59), recessed positioning grooves (591) are arranged on an end surface of the projecting ribs (590) which faces towards the vertical wall of the seal housing (1), projecting positioning ribs (12) fitting with the positioning grooves (591) of the positioning wheel (522) are arranged on the vertical wall of the seal housing (1) correspondingly.

2. The integrated overprint colorful seal with multiple printing surfaces as set forth in claim 1, wherein gear ratio of the gear and the rack (200) is 3:1 or 4:1 based on a shape of the seal body (4) being a regular triangular prism or a quadrangular prism.

3. The integrated overprint colorful seal with multiple printing surfaces as set forth in claim 1, wherein a recess (201) fitting with the projecting ribs (590) of the positioning wheel (59) is formed at a bottom of the vertical groove (20) which is at a same side as the positioning wheel (59), when the seal housing (1) is depressed, the seal body (4) will move with the fixed shaft (7) along the vertical groove (20) to the bottom of the vertical groove (20), the projecting rib (590) of the positioning wheel (59) will embed into the recess (201) of the vertical groove (20).

4. An integrated overprint colorful seal with multiple printing surfaces, comprising:

a seal housing (1), a middle frame (2) accommodated in the seal housing (1), a spring (3) squeezed between the seal housing and the middle frame, wherein the integrated overprint colorful seal further comprises a seal body (4) in a regular triangular prism or a quadrangular prism shape, and a driving mechanism (5);

each side surface of the seal body (4) in the regular triangular prism or quadrangular prism shape is a printing surface (60) for printing a different color;

a fixed shaft (7) passes through centers of two end surfaces (42) of the seal body (4) which are parallel to each other, two ends of the fixed shaft (7) pass through vertical grooves (20) on vertical walls at two sides of the middle frame (2) respectively and are supported on the vertical walls at two sides of a lower portion of the seal housing (1), so that the seal body (4) is suspended in the middle frame (2);

the drive mechanism (5) is mounted at both ends of the fixed shaft (7), wherein a ratchet (510) or gear (581) of the drive mechanism (5) is fixed on one end surface (42) of the seal body (4), and a pawl (512) or rack (200) which engages with the ratchet (510) or gear (581) to drive the seal body (4) to rotate is fixed on the middle frame (2); when the seal housing (1) is not depressed, the spring (3) is in an extended state and the printing surface (60) in one color of the seal body (4) faces downwards;

when the seal housing (1) is depressed, the spring (3) will be squeezed, the seal body (4) will be moved downwards along the vertical grooves (20) on the vertical walls at two sides of the middle frame (2) with the fixed shaft (7) until the printing surface (60) in the one color prints on a target;

when the seal housing (1) is relaxed, the seal body (4) will be moved upwards with the fixed shaft (7) while the driving mechanism (5) will drive the seal body (4) to rotate about the axis of the fixed shaft (7) until the printing surface (60) of the seal body (4) in another color faces downwards; when the seal housing (1) is depressed again, the printing surface (60) in another color will overprint on the existing printed pattern on the target, and so forth, colorful printed pattern will be presented on the target after the printing surfaces (60) in three colors or four colors are overprinted;

wherein the driving mechanism (5) comprises a pawl mechanism (51) and a positioning mechanism (52), the pawl mechanism (51) comprises a ratchet (510), a pawl (512) and a pawl return spring (513), the ratchet (510) is fixed on one end of the fixed shaft (7) and is integrated with the fixed shaft (7), the pawl and the pawl return spring are fixed on the an inner wall of the middle frame (2);

the positioning mechanism (52) comprises an anti-inertia positioning wheel (522), the anti-inertia positioning wheel (522) is mounted on the fixed shaft (7) on one of the end surfaces of the seal body (4) and is fixed on an other end surface of the seal body (4), three or four projecting ribs (5220) are distributed uniformly on tubular outer wall of the positioning wheel (522) and recessed positioning grooves (5221) are arranged on the end surface of projecting ribs (5220) which faces towards the vertical wall of the seal housing (1), projecting positioning ribs fitting with the positioning grooves (5221) of the positioning wheel (522) are arranged on the vertical wall of the seal housing (1) correspondingly;

when the seal body (4) moves upwards with the fixed shaft (7), the ratchet (510) will be driven by the pawl (512) to rotate, and the seal body (4) will be driven to rotate around the fixed shaft (7) by one-third or one quarter of circumference, so that the positioning grooves (5221) is embedded by the projecting positioning ribs (12) on the vertical wall of the seal housing (1) to be positioned accurately.

5. The integrated overprint colorful seal with multiple printing surfaces as set forth in claim 4, wherein the positioning mechanism (52) further comprises an anti-reversal one-way bearing (521), and the anti-reverse one-way bearing (521) has an inner ring which is fixed on the fixed shaft (7) on a same side as the anti-inertial positioning wheel (522), the anti-inertial positioning wheel (522) is sleeved on an outer ring of the anti-reversal one-way bearing (521) slidably and is fixed on the end surface of the seal body (4).

6. The integrated overprint colorful seal with multiple printing surfaces as set forth in claim 4, wherein a recess (201) fitting with the projecting ribs (5220) of the positioning wheel (522) is formed at a bottom of the vertical groove (20) which is at a same side as the positioning wheel (522), when the seal housing (1) is depressed, the seal body (4) will move with the fixed shaft (7) along the vertical groove (20) to the bottom of the vertical groove (20), the projecting rib (5220) of the positioning wheel (522) will embed into the recess (201) of the vertical groove (20).

7. The integrated overprint colorful seal with multiple printing surfaces as set forth in claim 4, wherein a number of the teeth of the ratchet (510) is three or four based on the seal body (4) being in a regular triangular prism shape or quadrangular prism shape, and the number of teeth are distributed uniformly.

8. The integrated overprint colorful seal with multiple printing surfaces as set forth in claim 4, wherein on the fixed shaft (7) at a same end as the positioning mechanism (52), the top end part inserted into the vertical wall of the seal housing (1) is in a flat shape which is not rotatable.

9. The integrated overprint colorful seal with multiple printing surfaces as set forth in claim 4, wherein the printing surfaces (60) are fixed on ink pads (61) which can store ink and are integrated with the ink pads (61), the ink pads (61) are embedded detachably in side surfaces (41) of the seal body (4) in regular triangular prism shape or quadrangular prism shape, and refilling holes (610) for refilling ink are formed on the ink pads (61).

* * * * *